US011370242B2

(12) United States Patent
Olsen et al.

(10) Patent No.: US 11,370,242 B2
(45) **Date of Patent: *Jun. 28, 2022**

(54) FOLDER STORAGE WITH REFERENCE APPARATUS

(71) Applicant: ASI Business Group, Wilsonville, OR (US)

(72) Inventors: Jeffrey N Olsen, Wilsonville, OR (US); Agopos Ghossein, Beaverton, OR (US)

(73) Assignee: ASI Business Group, Wilsonville, OR (US)

( * ) Notice: Subject to any disclaimer, the term of this patent is extended or adjusted under 35 U.S.C. 154(b) by 381 days.

This patent is subject to a terminal disclaimer.

(21) Appl. No.: 16/679,590

(22) Filed: Nov. 11, 2019

(65) Prior Publication Data

US 2020/0070567 A1 Mar. 5, 2020

Related U.S. Application Data

(60) Continuation of application No. 14/812,973, filed on Jul. 29, 2015, now Pat. No. 10,471,765, which is a continuation-in-part of application No. 14/315,888, filed on Jun. 26, 2014, now abandoned, which is a division of application No. 13/630,705, filed on Sep. 28, 2012, now Pat. No. 8,857,616.

(60) Provisional application No. 62/165,581, filed on May 22, 2015, provisional application No. 62/030,787, filed on Jul. 30, 2014, provisional application No.

(Continued)

(51) Int. Cl.

| | |
|---|---|
| ***B65D 5/50*** | (2006.01) |
| ***B42F 19/02*** | (2006.01) |
| ***B65D 5/36*** | (2006.01) |
| ***B65D 27/22*** | (2006.01) |
| ***B42F 7/06*** | (2006.01) |
| ***B42F 17/16*** | (2006.01) |
| ***B42F 15/00*** | (2006.01) |

(52) U.S. Cl.

CPC ..... *B42F 7/06* (2013.01); *B42F 15/0058* (2013.01); *B42F 17/16* (2013.01); *B42F 19/02* (2013.01); *B65D 5/3685* (2013.01); *B65D 5/5014* (2013.01); *B65D 27/22* (2013.01); *Y10T 428/24223* (2015.01)

(58) Field of Classification Search

CPC .. B42F 7/06; B42F 17/16; B42F 17/20; B42F 19/02

USPC ..... 206/495

See application file for complete search history.

(56) References Cited

U.S. PATENT DOCUMENTS

| | | | |
|---|---|---|---|
| 730,933 | A | 6/1903 | Lawson |
| 1,194,440 | A | 8/1916 | Swortfiguer |

(Continued)

OTHER PUBLICATIONS

United States Patent and Trademark Office, Office Action for U.S. Appl. No. 14/315,888, dated Nov. 28, 2014, 10 pages.

(Continued)

*Primary Examiner* — Anthony D Stashick
*Assistant Examiner* — Raven Collins
(74) *Attorney, Agent, or Firm* — Chernoff, Vilhauer, McClung & Stenzel, LLP

(57) ABSTRACT

Folders are disclosed. In some embodiments, the folder may include a unitary planar material folded along a transverse fold forming a front panel and a rear panel. The front panel may be folded over the rear panel along the transverse fold. At least one reference apparatus may be formed with at least one of the front and rear panels. The at least one reference apparatus may be configured to be detached from the at least one of the front and rear panels.

13 Claims, 9 Drawing Sheets

Related U.S. Application Data

61/604,415, filed on Feb. 28, 2012, provisional application No. 61/544,136, filed on Oct. 6, 2011.

(56) References Cited

U.S. PATENT DOCUMENTS

| | | | |
|---|---|---|---|
| 2,002,571 | A | 5/1935 | Farrelly |
| 2,288,342 | A | 6/1942 | Brooks |
| 3,655,119 | A | 4/1972 | Thompson |
| 4,058,206 | A | 11/1977 | Morse et al. |
| 5,921,463 | A | 7/1999 | Boyle |
| 6,082,612 | A | 7/2000 | Black |
| 7,219,829 | B2 | 5/2007 | Treat |
| 7,407,469 | B2 | 8/2008 | Lockhart |
| 8,857,616 | B2 | 10/2014 | Olsen |
| 10,471,765 | B2 | 11/2019 | Olsen |
| 2002/0100797 | A1 | 8/2002 | Hollingsworth et al. |
| 2006/0231605 | A1 | 10/2006 | Collins |
| 2008/0066836 | A1 | 3/2008 | Barnard |
| 2014/0151442 | A1 | 6/2014 | Gilbertson |

OTHER PUBLICATIONS

United States Patent and Trademark Office, Office Action for U.S. Appl. No. 14/315,888, dated Jun. 12, 2015, 12 pages.
United States Patent and Trademark Office, Restriction Requirement for U.S. Appl. No. 14/812,973, dated Jan. 8, 2018, 6 pages.
United States Patent and Trademark Office, Office Action for U.S. Appl. No. 14/812,973, dated Jan. 18, 2019, 19 pages.

FOLDER STORAGE WITH REFERENCE APPARATUS

CROSS-REFERENCE TO RELATED APPLICATIONS

This application is a continuation of U.S. patent application Ser. No. 14/812,973, filed Jul. 29, 2015, which is a continuation-in-part of U.S. patent application Ser. No. 14/315,888, filed Jun. 26, 2014, which is a divisional of U.S. patent application Ser. No. 13/630,705, filed Sep. 28, 2012, now U.S. Pat. No. 8,857,616, issued Oct. 14, 2014, which claims priority to U.S. Provisional Patent Application Ser. No. 61/544,136, filed Oct. 6, 2011 and U.S. Provisional Patent Application Ser. No. 61/604,415, filed Feb. 28, 2012. U.S. patent application Ser. No. 14/315,888 also claims the benefit of U.S. Provisional Patent Application No. 62/030,787, filed Jul. 30, 2014 and U.S. Provisional Patent Application No. 62/165,581, filed May 22, 2015. The complete disclosures of the above applications are hereby incorporated by reference for all purposes.

BACKGROUND OF THE DISCLOSURE

A reference apparatus, such as a pocket guide or wallet guide, provides a user a convenient way to store valuable information. For example, a reference apparatus may be used to store medical and/or emergency information. The reference apparatus may be sized such that a person is more likely to carry the apparatus with him or her and have that apparatus available when needed. Additionally, the reference apparatus may be in a form that allows a person to easily add and/or delete information stored in or on the reference apparatus.

When reference apparatuses are provided or handed out to a user, providing a convenient way to secure a reference apparatus may be important to prevent misplacement or damage. For example, when a reference apparatus is provided to a user with other items of different types or sizes, the reference apparatus may not be secured to the other items or may be secured to the other items but with a staple, which may lead to the reference apparatus being lost, a reduction in accessibility, or tearing when possibly removing a staple.

Packaging systems, such as packages and envelopes, are used to contain one or more items for a variety of purposes. For example, packaging systems may be used to transport or store items. The items may be of different types and sizes, such as documents, business cards, digital media (such as CDs, DVDs, floppy disks, and USBs), photographs, and/or digital cards (such as credit cards, and phone cards).

When packaging systems are used to contain items of different types or sizes, securing those items within the packaging systems may be important to prevent misplacing and/or damaging items. For example, when packaging systems are used to contain business cards, the business cards are typically stapled to enclosed documents or enclosed but not secured within the packaging system, which may lead to the business cards being lost, a reduction in accessibility, or tearing when possibly removing a staple. Additionally, when packaging systems are used to contain documents, organizing the documents within the packaging system may be important to keep valuable information properly stored.

Examples of packaging systems are disclosed in U.S. Pat. Nos. 5,950,401, 5,775,494, 6,288,996, 8,249,919, 6,640,473, 6,666,378, 6,820,799, 6,845,864, 6,951,279, and 7,556,148. The disclosures of these and all other publications referenced herein are incorporated by reference in their entirety for all purposes.

Advantages of the present disclosure will be more readily understood after considering the drawings and the Detailed Description.

SUMMARY OF THE DISCLOSURE

Some embodiments provide a folder. In some embodiments, the folder may include a unitary planar material folded along a transverse fold forming a front panel and a rear panel. The front panel may be folded over the rear panel along the transverse fold. The rear panel may include an additional fold defining first and second portions. One of the front and rear panels may include lateral projections folded along longitudinal folds and affixed to the other of the front and rear panels to form a document receptacle between the front panel and the rear panel. At least one reference apparatus may be formed with at least one of the front and rear panels. The at least one reference apparatus may be configured to be detached from the at least one of the front and rear panels. The at least one reference apparatus may include a first panel, a second panel, and a third panel disposed between the first and second panels. When the at least one reference apparatus is detached from the at least one of the front and rear panels, the first and second panels may be configured to be folded between a folded position in which the first and second panels are parallel to the third panel, and an unfolded position in which the first and second panels are coplanar with the third panel. One of the first and second panels may include a slot configured to receive an end portion of the other of the first and second panels to secure the first, second, and third panels together in the folded position.

In some embodiments, the folder may include a unitary planar material folded along first and second transverse folds forming a front panel, a lid, and a rear panel disposed between the front panel and the lid. The front panel may be folded over the rear panel along the first transverse fold. One of the front and rear panels may include lateral projections folded along longitudinal folds and affixed to the other of the front and rear panels to form a document receptacle between the front panel and the rear panel. The lid may be configured to be folded over the front panel along the second transverse fold to form a closure for the document receptacle. At least one reference apparatus may be formed with at least one of the front panel, the rear panel, and the lid. The at least one reference apparatus may be configured to be detached from the at least one of the front panel, the rear panel, and the lid. The at least one reference apparatus may include a first panel, a second panel, and a third panel disposed between the first and second panels. When the at least one reference apparatus is detached from the at least one of the front panel, the rear panel, and the lid, the first and second panels may be configured to be folded between a folded position in which the first and second panels are parallel to the third panel, and an unfolded position in which the first and second panels are coplanar with the third panel. One of the first and second panels may include a slot configured to receive an end portion of the other of the first and second panels to secure the first, second, and third panels together in the folded position.

In some embodiments, the folder may include a unitary planar material folded along first and second folds forming one or more front panels and a rear panel. The one or more front panels may be folded over the rear panel along the first fold. One of the one or more front panels and the rear panel may include lateral projections folded along longitudinal folds and affixed to the other of the one or more front panels and the rear panel to form one or more document receptacles between the one or more front panels and the rear panel. The rear panel may have a first portion and a second portion. The first portion may be configured to be folded over the second portion along the second fold. At least one reference apparatus formed with at least one of the one or more front panels and the rear panel. The at least one reference apparatus may be configured to be detached from at least one of the one or more front panels and the rear panel. The at least one reference apparatus may include a first panel, a second panel, and a third panel disposed between the first and second panels. When the at least one reference apparatus is detached from the at least one of the one or more front panels and the rear panel, the first and second panels may be configured to be folded between a folded position in which the first and second panels are parallel to the third panel, and an unfolded position in which the first and second panels are coplanar with the third panel. One of the first and second panels may include a slot configured to receive an end portion of the other of the first and second panels to secure the first, second, and third panels together in the folded position.

DETAILED DESCRIPTION OF THE DISCLOSURE

Figure 1:
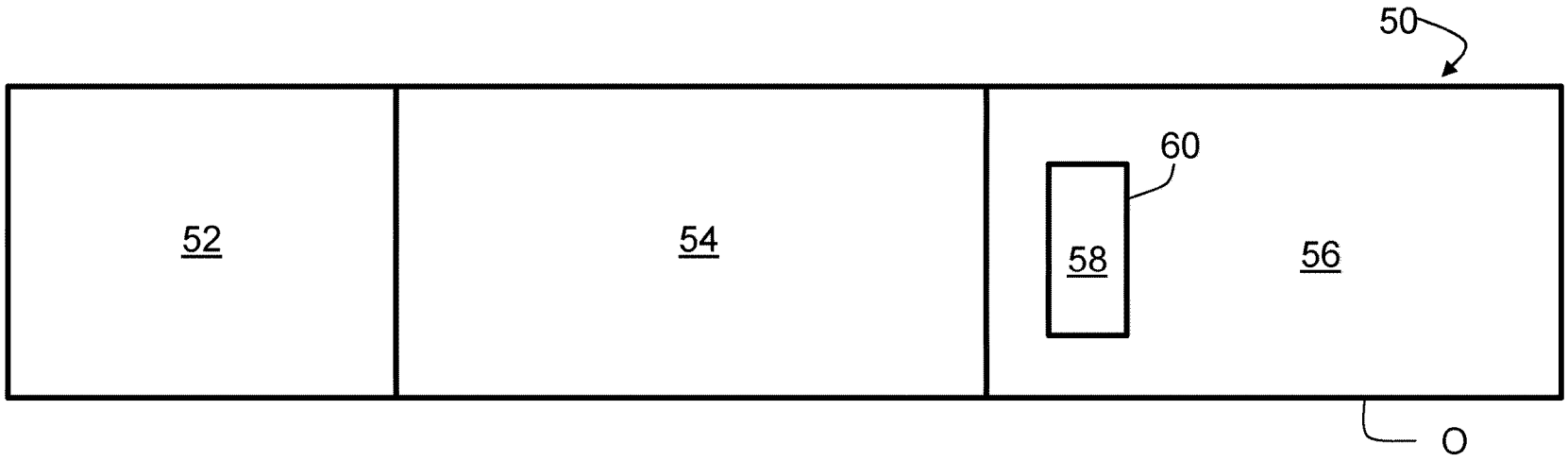
FIG. 1 is a schematic view of an example of a reference apparatus shown in an open position.
Figure 2:
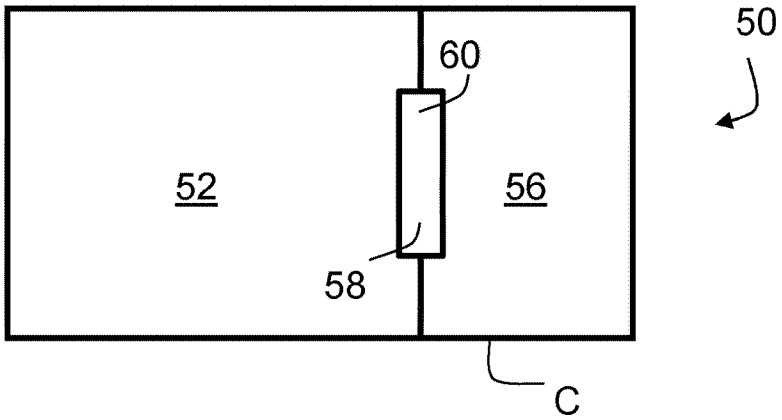
FIG. 2 is a schematic view of the reference apparatus of FIG. 1 shown in a closed position.
Figure 3:
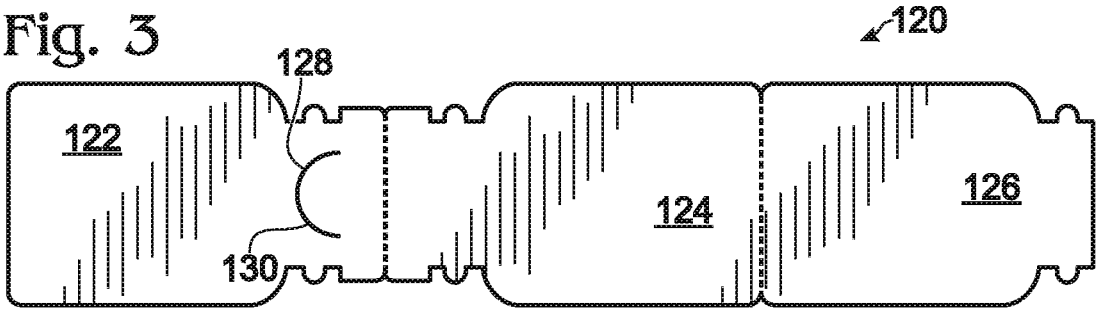
FIGS. 3-7 are various views of another example of the reference apparatus of FIGS. 1-2.
Figure 4:
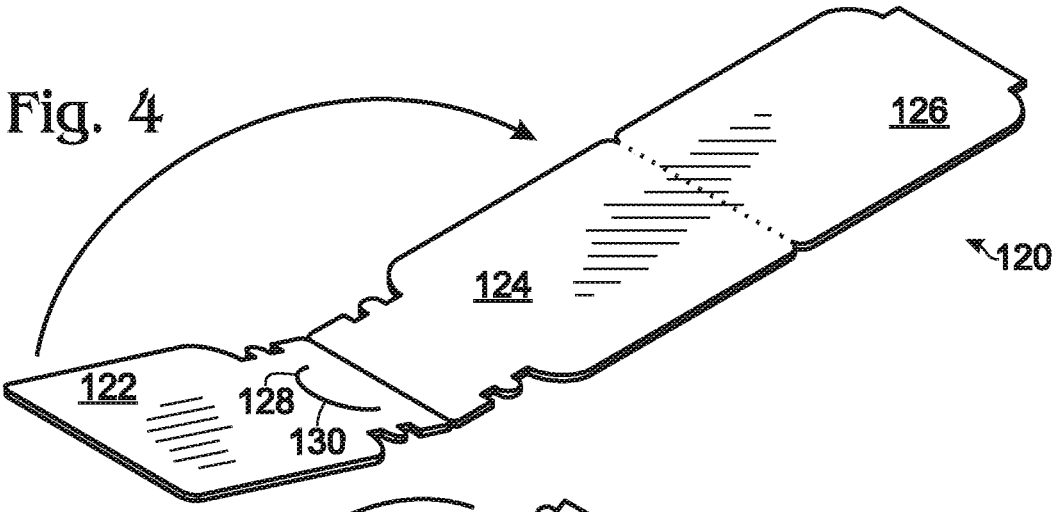
Figure 5:
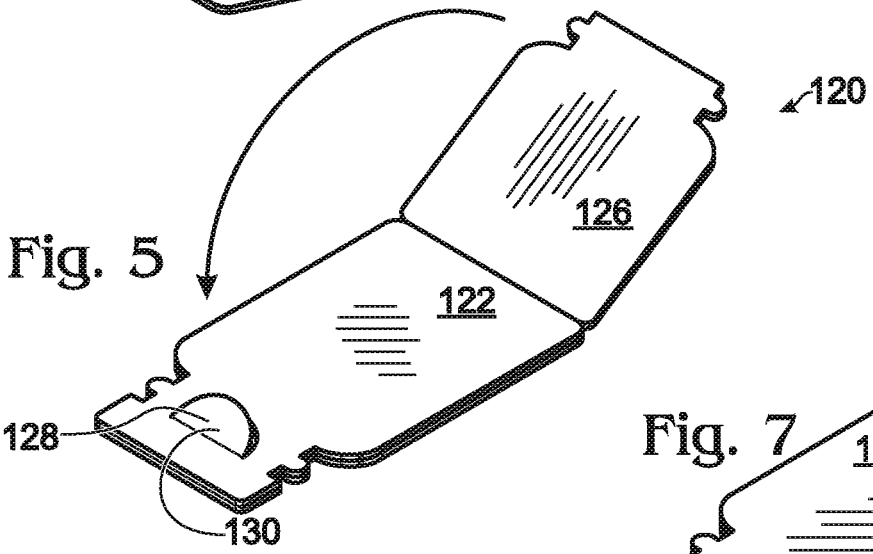
Figure 6:
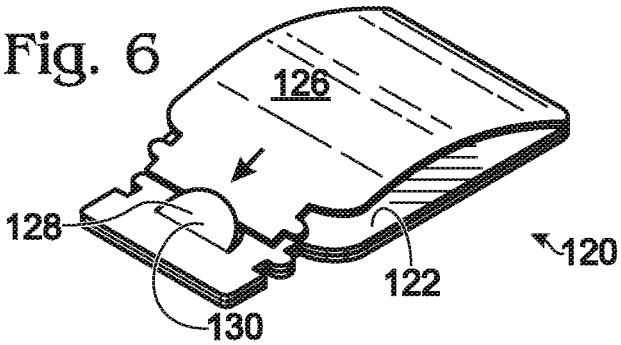
Figure 7:
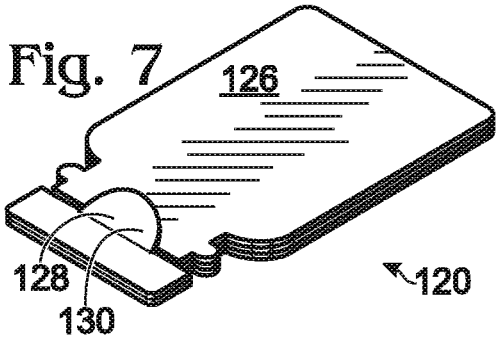

FIGS. 1-2 show an example of a reference apparatus 50. The reference apparatus may be made of one or more suitable materials. For example, the reference apparatus may be made of a unitary planar material, such as paper and/or cardboard. Alternatively, or additionally, the reference apparatus may include one or more polymer materials, such as one or more vinyl materials. The materials used may be of any suitable thickness. For example, when reference apparatus 50 is made of paper, the paper may have a thickness of 14-point C1S or C2S (coated two sides) or 12-point C1S or C2S, 18 pt C1S or C2S. The thickness may be selected for durability of the reference apparatus.

Reference apparatus 50 may have any suitable dimensions. For example, the reference apparatus may sized to be contained in a wallet or purse, such as about 3⅜ inches by about 2 inches (or about 3 or 3½ inches by about 2 inches), or about the size of a credit card (85.60×53.98 millimeters). Additionally, the reference apparatus may include any suitable shape(s). For example, the reference apparatus may be rectangular, square, triangular, circular, etc. In some embodiments, the reference apparatus may be shaped to resemble any suitable objects, such as a pill bottle, a capsule, etc.

Reference apparatus 50 may include any suitable structure configured to store information. For example, the reference apparatus may include a left panel 52, a center panel 54, and a right panel 56. In some examples, the reference apparatus may include linear folds that define the panels. For example, the reference apparatus may include a first linear fold dividing the left and center panels, and a second linear fold dividing the center and right panels. In some examples, the linear folds may be parallel to each other. Although reference apparatus 50 is shown to include three panels, the reference apparatus may include two, four, five, six, or more panels. In some examples, the reference apparatus may include only the left, center, and right panels. In other words, the reference apparatus may exclude panels and/or other structure other than the left, center, and right panels.

One or more of the panels may be configured to facilitate folding of the panels (such as along the first and second linear folds) between a plurality of positions, including an unfolded or open position O (shown in FIG. 1) in which the panels are coplanar, and a closed position C (shown in FIG. 2) in which the panels are parallel to and in different planes from each other. Additionally, or alternatively, those panels may be configured to allow one or more of the panels to be secured together in the closed position. For example, left panel 52 may be sized smaller than the center and/or right panels, such as smaller in length and/or width than the center and/or right panels. For example, the center and right panels may be sized about 3⅜ inches long by about 2 inches wide, while the left panel may be sized about 3 inches long by about 2 inches wide. Alternatively, the center and right panels may be sized about 3⁵⁄₁₆ inches long by about 2 inches wide, while left panel may be sized about 3¼ inches long by about 2 inches wide. The left, center, right panels may be elongate, such as in a direction perpendicular to the first and second linear folds as shown in FIG. 1. Although left panel 52 is shown to be sized smaller than the center and right panels, and the center panel is sized about the same as the right panel, the left, center, and right panels may have any suitable dimensions. For example, both the left and right panels may be smaller than the center panel, such as smaller in length and/or width than the center panel.

Additionally, one or more of the panels (such as right panel 56) may include at least one attachment device 58, which may include any suitable structure configured to retain one or more of the panels in the closed position. For example, the attachment device may include at least one tab 60. Alternatively, or additionally, the attachment device(s) may include projections, apertures, adhesive, and/or other suitable attachment devices. When attachment device 58 includes tab 60, the tab may be any suitable size. Additionally, tab 60 may be any suitable shape(s) configured to secure one or more of the panels in the closed position. For example, the tab may be rectilinear and/or curvilinear. In some examples, tab 60 may be formed by a slot in, for example, the right panel. The slot may be rectilinear and/or curvilinear. An example of a curvilinear slot is a half-moon slot. Moreover, tab 60 may include apertures (not shown) and/or other structure configured to prevent tearing or ripping of the slot.

Although right panel 56 is shown to include a single attachment device, the right panel may include two or more attachment devices, which may be in any suitable arrangement or orientation. Alternatively, or additionally, the left and/or center panels may include one or more attachment devices. In some embodiments, the attachment device(s) on one panel may interact with attachment device(s) of the other panel(s) to secure the one or more of the panels in the closed position. For example, center panel 54 may include, for example, an aperture (not shown) configured to receive tab 60 to secure the right panel to the center panel (or vice-versa) independent of the left panel.

In some examples, the reference apparatus may include only a single attachment device (such as a single slot) configured to receive an edge of a panel. In other words, the reference apparatus may exclude attachment devices other than the single attachment device. When the attachment device is a slot, the reference apparatus may exclude attachment devices (such as adhesive, projections etc.) other than the single slot. For example, the right panel may include only a single slot configured to receive an edge or end portion of the left panel.

Information, such as medical and/or emergency information, may be printed and/or written on one or more of the panels. For example, medications, allergies, and doctor names may be printed and/or written on one or more of the panels. Additionally, advertising information may be printed on a front panel (such as the left or right panel) when the reference apparatus is in the closed position.

In use, reference apparatus 50 may be moved to the open position to print and/or write information on one or more of the panels. The panels may then be folded to the closed position. For example, the right panel may be folded toward the center panel and the left panel may be folded toward the center panel. An edge of the left panel may be tucked under the tab of the right panel, which may secure the panels in the closed position. A user may then insert the reference apparatus in a wallet, purse, pocket, or other suitable container.

FIGS. 3-7 show another example of reference apparatus 50, which is generally indicated at 120. Related reference numbers are used (e.g., 52 and 122, 54 and 124, etc.) for features related to reference apparatus 50. Related features may be identical, similar, or dissimilar in different examples. For the sake of brevity, related features are not redundantly explained in the example of FIGS. 3-7. Instead, the use of related numbers shall cue the reader that the feature with a related number may be similar to the related features in reference apparatus 50.

Figure 8:
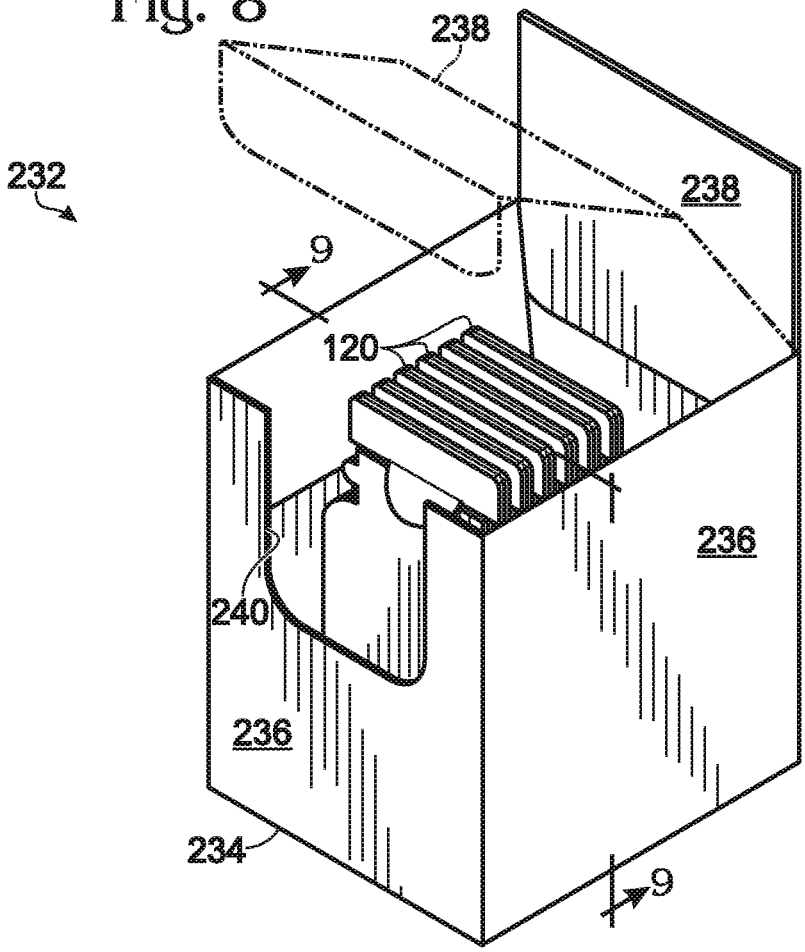
FIG. 8 is an isometric view of an example of a storage and dispensing apparatus for the reference apparatus of FIG. 1.
Figure 9:
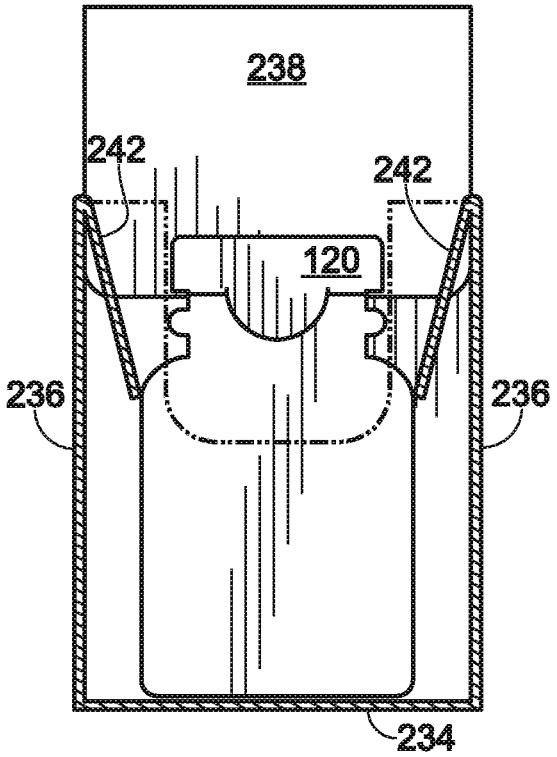
FIG. 9 is a sectional view of the storage and dispensing apparatus of FIG. 8 taken along lines 9-9 in FIG. 8.

FIGS. 8-9 show an example of a storage and dispensing apparatus 232 for reference apparatus 120. Although a specific example of a storage and dispensing apparatus for reference apparatus 120 is shown, the reference apparatus may be stored and/or dispensed in any suitable apparatus.

The storage and dispensing apparatus may include any suitable structure configured to store and/or dispense reference apparatus 50 or reference apparatus 120. For example, the storage and dispensing apparatus may include a bottom panel 234, a plurality of side panels 236, and a top panel 238 to form a box and/or other suitable shapes. The box may be any suitable shapes, such as a cube or rectangular prism. Alternatively, the panels may form a sphere, a pyramid, a tetrahedron, a cylinder, a cone, and/or other suitable shapes.

At least one of the side panels may include an aperture 240 sized to allow a user to obtain one or more of the reference apparatus from the storage and dispensing apparatus. Additionally, the aperture may be sized to display the reference apparatus when in the storage and dispensing apparatus. One or more of the side panels may include flap(s) 242 and/or other structure configured to provide tension to retain the reference apparatus in an upright position. For example, two of the side panels may include flaps. The top panel may cover the aperture and/or flaps when in a closed position.

The top panel may pivot into a plurality of intermediate positions, such as shown in dashed lines FIG. 8. Although the top panel is shown to be attached to a specific side panel, the top panel may be attached to any suitable side panel. The top panel also may be moved and/or folded into a dispensing and/or display position, such as shown in solid lines in FIG. 8. Information, such as advertising, medical, and/or emergency information, may be printed and/or written on one or more of the panels of the storage and dispensing apparatus.

In use, a plurality of reference apparatus may be placed in the storage and dispensing apparatus and the top panel moved to the closed position for transport and/or storage. When moved to a desired dispensing location, the top panel may be moved to the dispensing position, such as shown in FIG. 8, to allow patients and/or other users to remove a reference apparatus from the storage and dispensing apparatus. The storage and dispensing apparatus may be configured to be disassembled and/or unfolded, and then assembled and folded for use.

Examples of a packaging system 300 are shown in FIGS. 10-13. Unless otherwise specified, packaging system 300 may, but is not required to contain at least one of the structures, components, functionality, and/or variations described, illustrated, and/or incorporated herein.

FIGS. 10-13 show an example of the packaging system 300. The packaging system may be made of one or more suitable materials. For example, the packaging system may be made of a unitary planar material, such as paper and/or cardboard. Alternatively, or additionally, the packaging system may include one or more polymer materials, such as one or more vinyl materials. The materials used may be of any suitable thickness. For example, when packaging system 300 is made of paper, the paper may have a thickness of 12 or 14 point or 18 pt C1S, C2S, and/or S1B.

Packaging system 300 may have any suitable dimensions. For example, the packaging system may be sized to contain documents with dimensions of up to 8½×11 inches. Alternatively, the packaging system may be sized to contain documents with dimensions of up to 8½×14 inches, 11×17 inches, or any suitable dimensions. In some embodiments, the packaging system may be sized to avoid oversized postage. Additionally, the packaging system may include any suitable shape(s). For example, the packaging system may be rectangular, square, triangular, circular, etc. In some embodiments, the packaging system may be sized to avoid additional postage.

Packaging system 300 may include any suitable structure configured to contain one or more different types of items. For example, the packaging system may include a base envelope 310 and a lid 306. The base envelope may include a front panel 302 and a rear panel 304. The front and/or rear panels may be configured to facilitate insertion of items into the base envelope. For example, front panel 302 may be sized smaller than rear panel 304. Front panel 302 may be attached to rear panel 304 via side panels 308. When packaging system 300 is a unitary planar material, the material may include a plurality of folds defining the panels, lid, and/or reference apparatus (as described below).

Side panels 308 may be formed with rear panel 304 and the side panels may be attached to front panel 302 via any suitable method(s), such as via one or more suitable adhesives. Alternatively, side panels 308 may be formed with the front panel and the side panels may be attached to the rear panel via any suitable method(s), such as via one or more suitable adhesives. In some embodiments, there may be additional or alternative discrete or continuous panels that are attached to the front and/or rear panels via any suitable method(s). In some embodiments, the side panels may be configured to allow base envelope 310 to expand.

Additionally, front panel 302 may include any suitable structure configured to contain one or more different types of items. For example, front panel 302 may include at least one receiving slot (not shown). The receiving slot may be any suitable size to secure any suitable number of items. Additionally, the receiving slot may be any suitable shape configured to secure any suitable type(s) of items, such as business cards, photographs, CDs, DVDs, digital cards, etc. For example, the receiving slot may be rectilinear and/or curvilinear. Moreover, the receiving slot may include apertures and/or other structure configured to prevent tearing or ripping of that slot.

Moreover, front panel 302 may include at least one set of opposing slots 312. The opposing slots may be any suitable size to secure any suitable number of items. Additionally, opposing slots 312 may be any suitable shape configured to secure any suitable type(s) of items, such as business cards, CDs, DVDs, digital cards, etc. For example, the opposing slots may be rectilinear and/or curvilinear. Additionally, the opposing slots may be configured to hold an item in one or more positions. For example, an opposing slot may be configured to hold an item at any 90 degree rotation from a first position. Moreover, opposing slots 312 may include apertures (not shown) and/or other structure configured to prevent tearing or ripping of the slot. Although front panel 302 is shown to include three sets of opposing slots 312, 314 and 316, the front panel may include only one set of opposing slots or multiple sets, which may be in any suitable arrangement or orientation.

Figure 10:
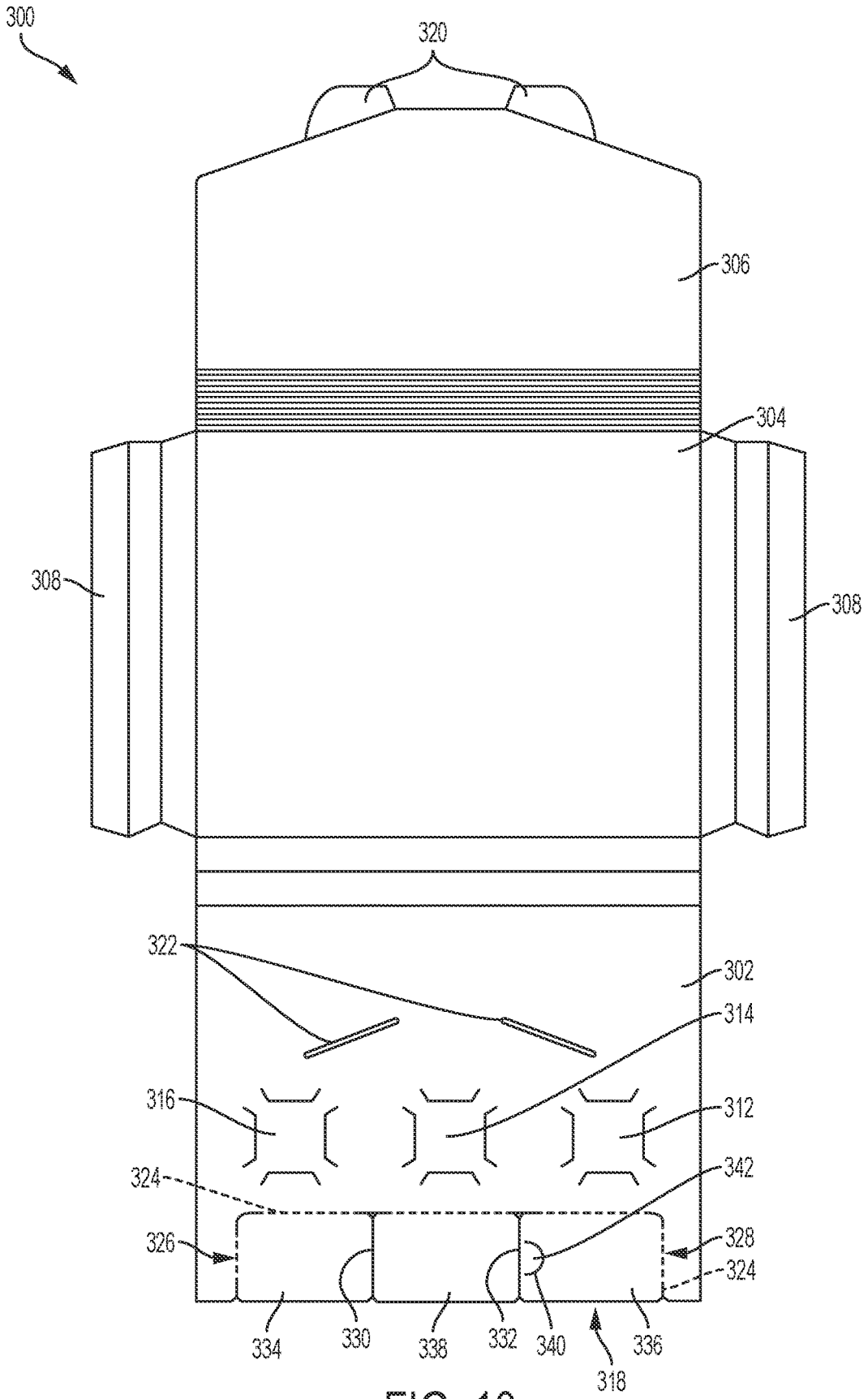
FIG. 10 is a bottom view of an example of a packaging system shown in a disassembled configuration, showing an example of a reference apparatus and sets of opposing slots.
Figure 11:
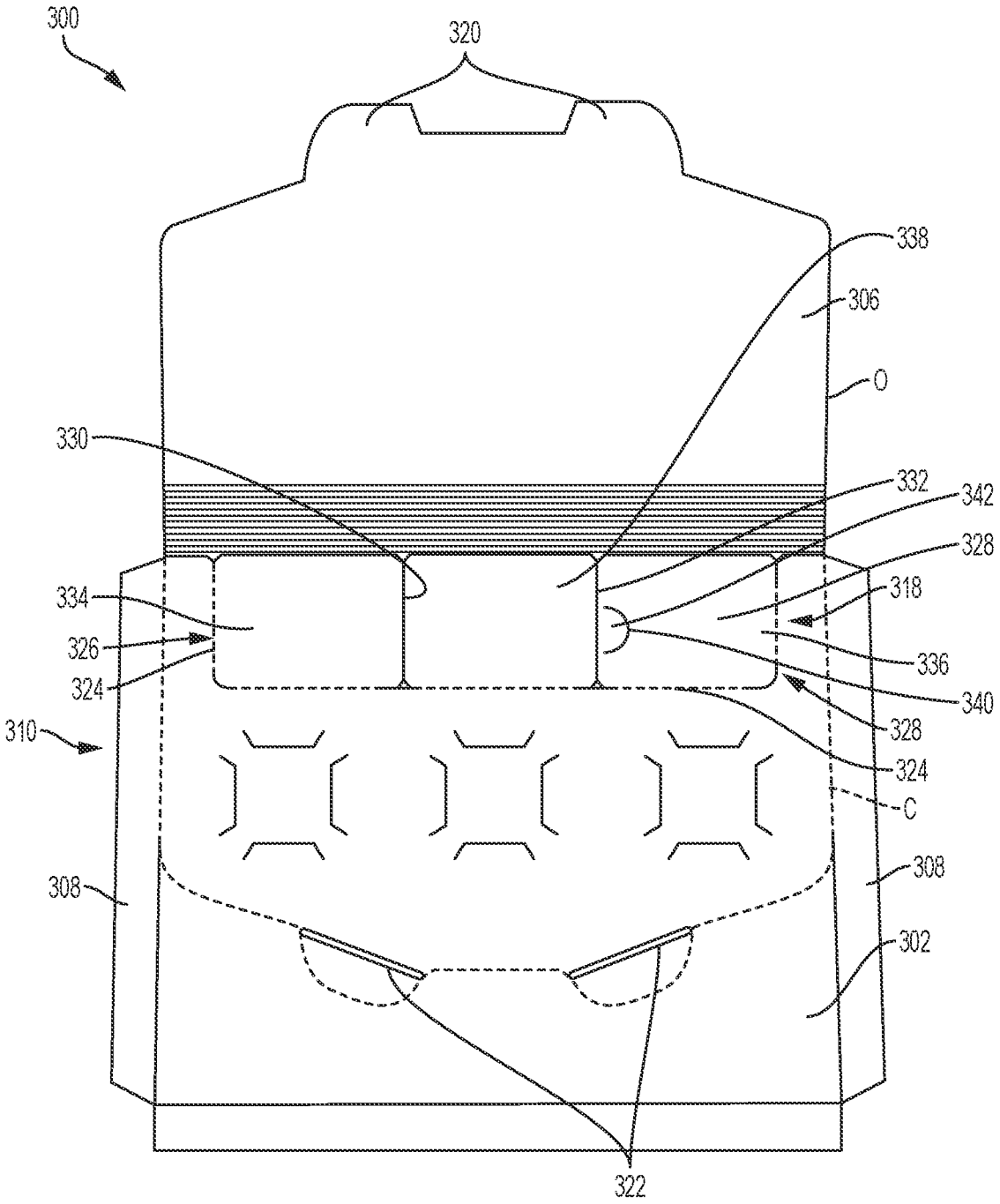
FIG. 11 is a top view of the packaging system of FIG. 10 shown in an assembled configuration.
Figure 12:
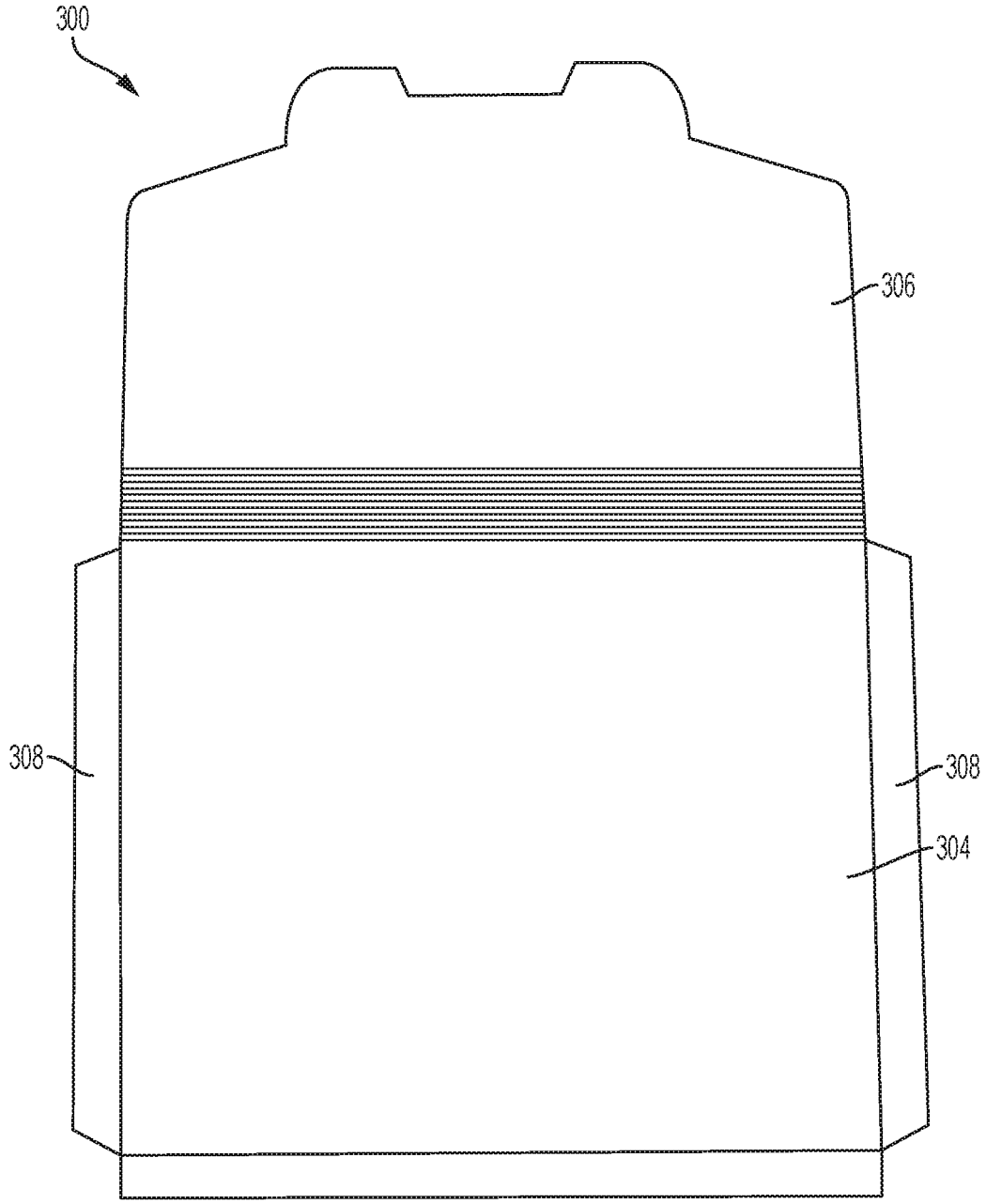
FIG. 12 is a bottom view of the packaging system of FIG. 10 shown with a lid in an open position.

Packaging system 300 may include at least one reference apparatus 318. The reference apparatus may be secured to packaging system 300 by any suitable methods. Additionally, the reference apparatus may be secured to the packaging system that allows the reference apparatus to be easily removed. For example, the reference apparatus may be secured to the packaging system with a perforated border (such as shown at 324 in FIGS. 10-11) and/or one or more suitable adhesives. In some embodiments, the reference apparatus may be secured within the packaging system. For example, the reference apparatus may be held within a slot or pocket of the packaging system. Moreover, the reference apparatus may be any suitable dimension or shape and may include any number of panels. For example, the reference apparatus on FIGS. 10-11 is shown to include opposed first end 326 and second end 328, and spaced first fold 330 and second fold 332 disposed between the opposed first and second ends. The reference apparatus on FIGS. 10-11 further includes a first panel 334 defined between the first end and the first fold, a second panel 336 defined between the second end and the second fold, and a third panel 338 disposed between the first and second panels and defined between the first and second folds. The second panel includes a slot 340 that defines a tab 342 shaped to secure an end portion of planar material between the tab and the remainder of the second panel. Although packaging system 300 is shown to include one reference apparatus on front panel 302, the packaging system may additionally, or alternatively, include one or more reference apparatuses on any portion(s) of the packaging system. For example, a reference apparatus may be on, secured to, or incorporated with lid 306 of the packaging system.

In some embodiments, packaging system 300 may be configured to allow base envelope 310 to expand. For example, the packaging system may include expansion gussets to allow the packaging system to expand to accommodate more items (as shown in FIG. 13).

Figure 13:
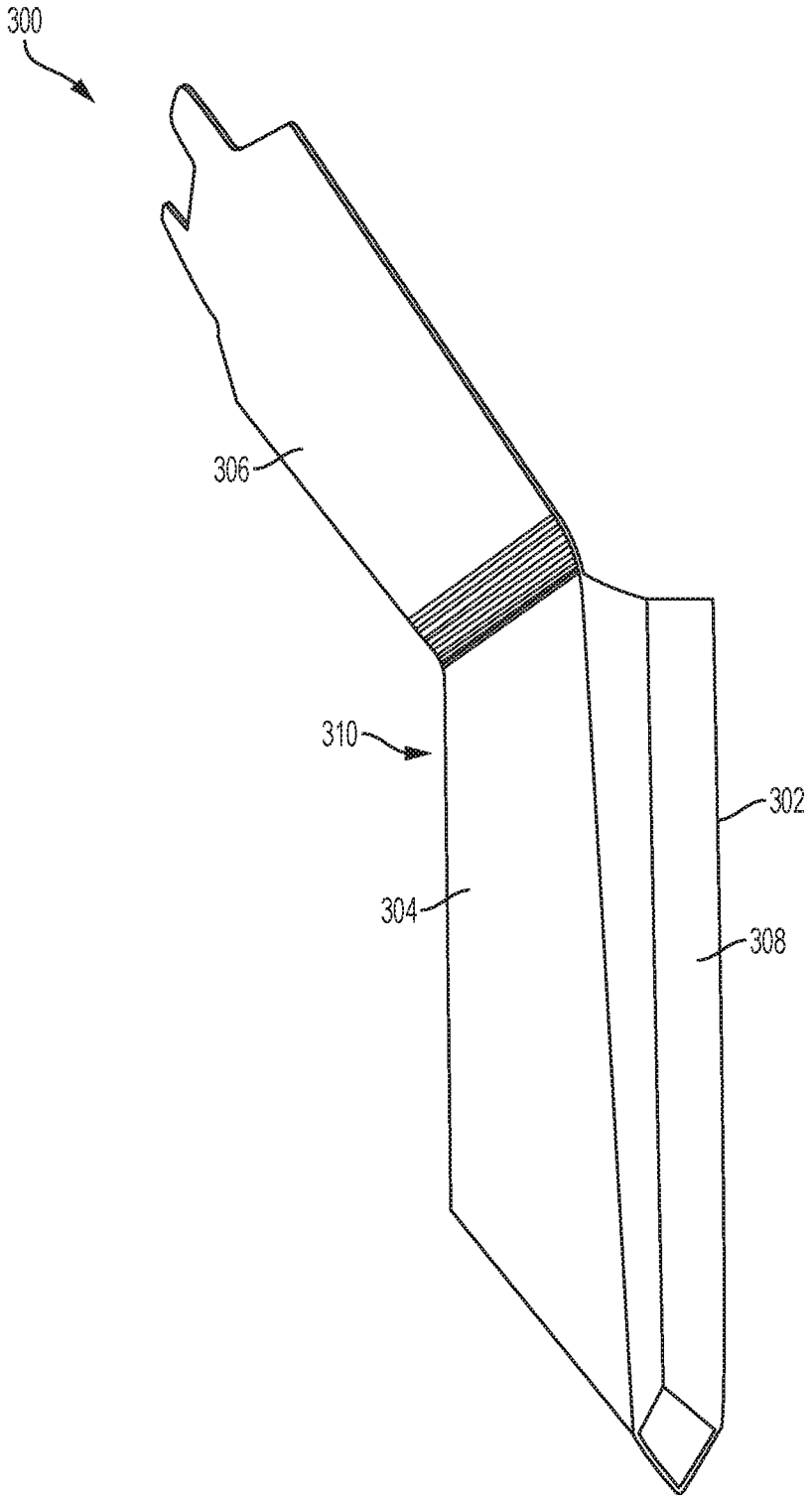
FIG. 13 is an isometric view of the packaging system of FIG. 10 shown with a lid in an open position.

Lid 306 may be pivotably connected to base envelope 310 such that the lid can move between an open position O in which items can be inserted or removed (as shown in FIGS. 11 and 13), and a closed position C in which items are secured within the packaging system (as shown in FIG. 11). Additionally, the lid may be configured to secure or attach the lid to the base envelope. For example, the lid may include at least one tab 320. The lid may be secured to the front panel of the base envelope. As shown in the example packaging system 300, the lid may be secured by inserting tabs 320 into tab slots 322. Additionally or alternatively, the lid may include at least one adhesive strip (such as an adhesive strip shown in U.S. Pat. No. 6,820,799). In some embodiments, the lid also may include at least one tear strip to facilitate opening of the packaging system. The tear strip may sometimes be referred to as a zip strip. Alternatively, or additionally, base envelope 310 may be configured to receive lid 306, such as one or more slots sized to receive the lid. The lid may be additionally or alternatively secured to the base envelope with any suitable form of packing tape, such as one or more tape dots. In some embodiments, packaging system 300 may include only tabs 320 and tab slots 322, and/or may exclude adhesive strips, packing tape, and/or other closure structure and/or mechanism.

In some embodiments, packaging system 300 may include at least one divider tab (not shown) within base envelope 310. The divider tabs may include any number of tabs and/or labels, which may be in any suitable arrangement or orientation. Additionally, the divider tabs may be secured within the packaging system by any suitable means.

Information, such as advertising information, instructional material, and/or medical information, may be printed on or attached to the lid and/or base envelope. For example, information that may be useful for patients discharged from a hospital or medical center, including providing information on diagnosis, medications, provider names, contact information, room number, admit dates, and/or discharge dates may be printed on the lid and the front panel of the packaging system. Additionally, information may be printed on or attached to a reference apparatus included with a packaging system. Furthermore, information may be printed or attached on the rear panel.

Figure 14:
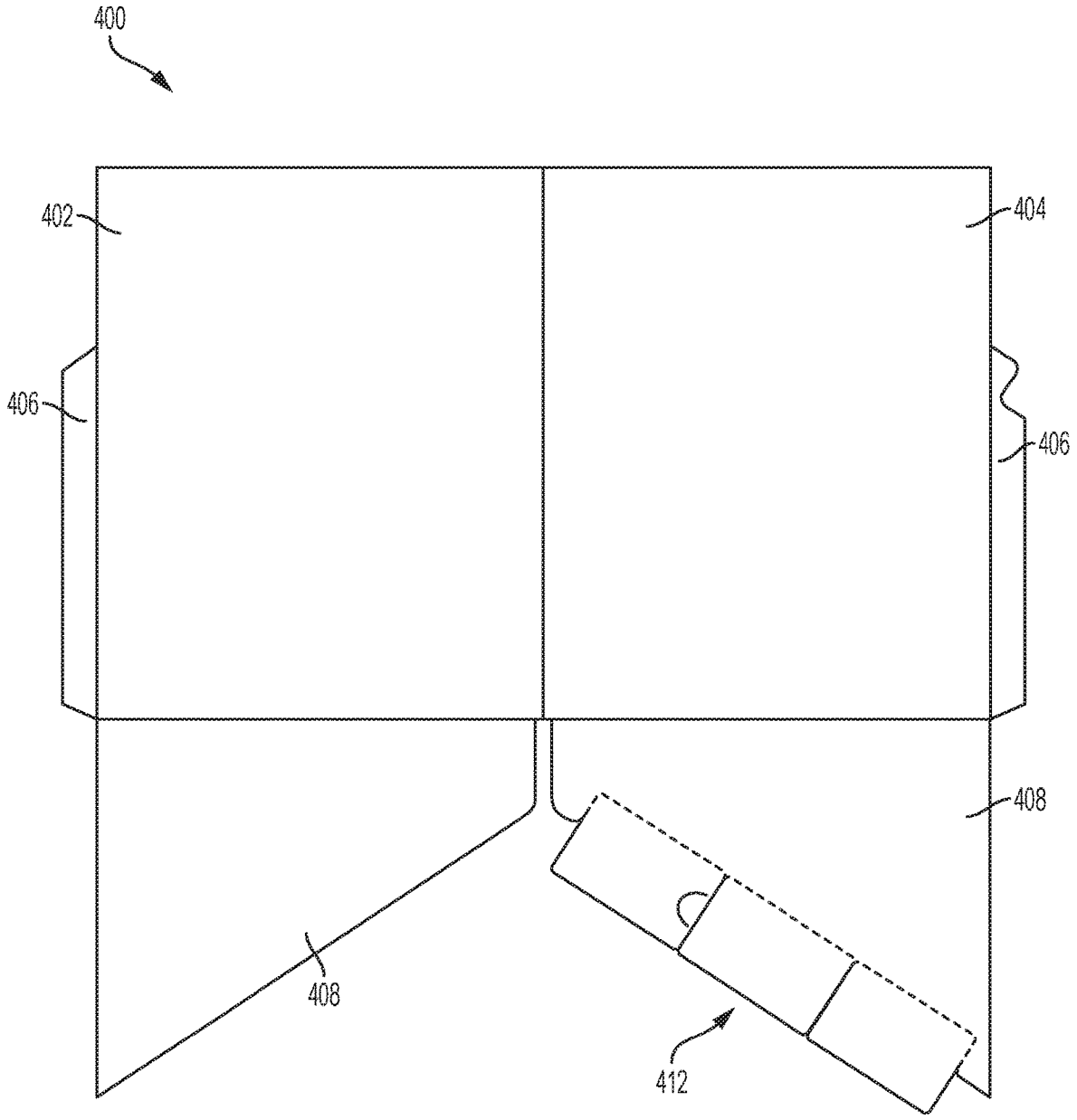
FIG. 14 is a bottom view of another example of a packaging system shown in a disassembled configuration.
Figure 15:
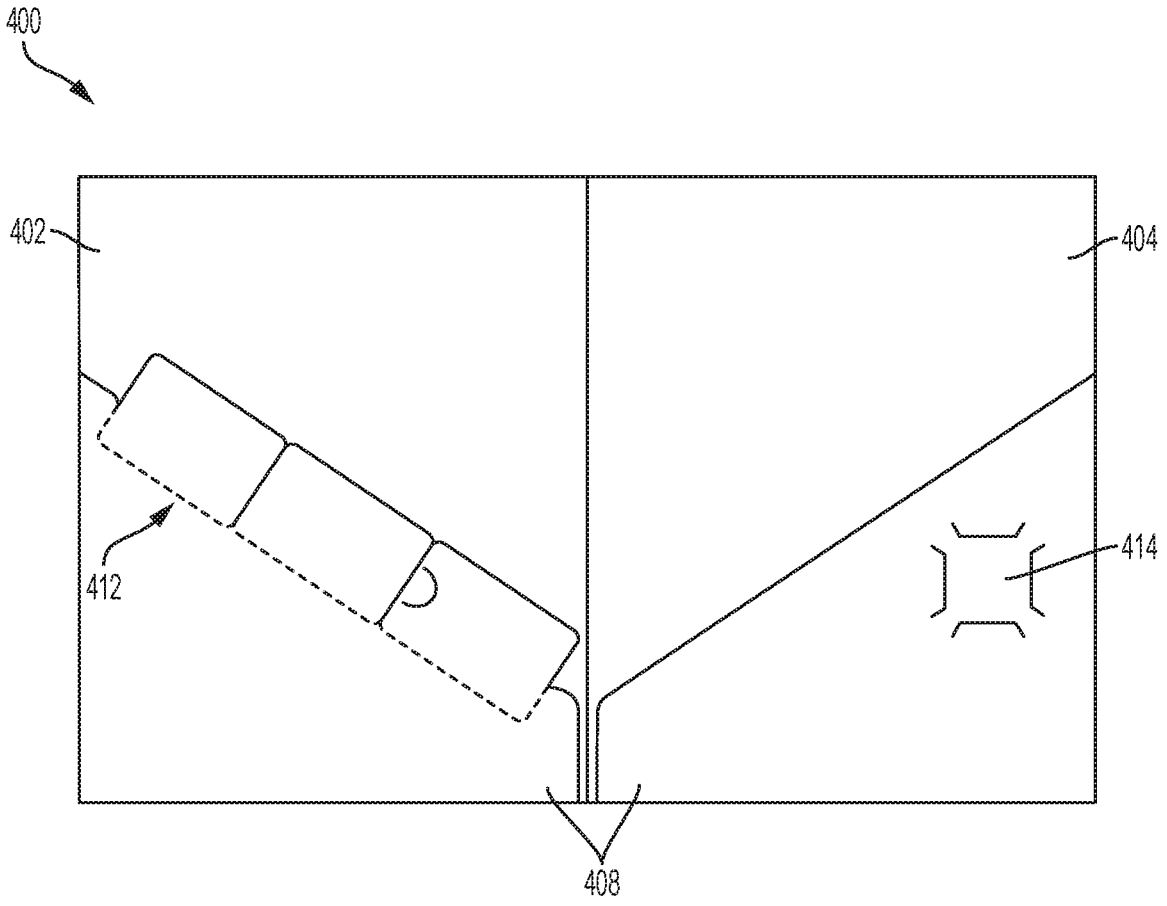
FIG. 15 is a top view of the packaging system of FIG. 14 shown in an assembled configuration, showing an example of a reference apparatus and a set of opposing slots.

FIGS. 14-15 show another embodiment of packaging system 300, which is generally indicated at 400. Packaging system 400 may be made of one or more suitable materials. For example, the packaging system may be made of a unitary planar material, such as paper and/or cardboard. Alternatively, or additionally, the packaging system may include one or more polymer materials, such as one or more vinyl materials. The materials used may be of any suitable thickness. For example, when packaging system 100 is made of paper, the paper may have a thickness of 12 point, 14 point, or 18 point C1S, C2S, and/or S1B.

Packaging system 400 may have any suitable dimensions. For example, the packaging system may be sized to contain documents with dimensions up to 9½×11¾ inches. Alternatively, the packaging system may be sized to contain smaller or larger documents, or other suitable contents of various sizes. Additionally, packaging system 400 may be configured in any suitable shape(s), such as rectangular, square, triangular, circular, etc. As shown in FIG. 14, one example of the packaging system may have an overall length of 20½ inches and an overall width of 20½ inches when disassembled, but packaging system 400 may have any suitable dimensions.

Packaging system 400 also may include any suitable structure configured to contain one or more different types of items. For example, packaging system 400 may include a first panel 402, a second panel 404, side panels 406, and bottom panels 408. When packaging system 400 is a unitary planar material, the material may include a plurality of folds defining the above panels and/or reference apparatus (described below). One or more of the above panels may form pockets to receive items (such as documents). Side panels 406 may be formed with first and second panels 402, 404 and may go over or under the bottom panels when assembled. Although bottom panels 408 are shown to be wedge-shaped, one or both bottom panels may be any suitable shape(s), such as triangular, square, rectangular, circular, semi-circular, etc.

Packaging system 400 may include at least one reference apparatus 412. The reference apparatus may be secured to packaging system 400 by any suitable methods. Additionally, the reference apparatus may be secured to the packaging system that allows the reference apparatus to be easily removed. For example, the reference apparatus may be secured to the packaging system with a perforated border and/or one or more suitable adhesives. In some examples, the reference apparatus may be formed with the other components of packaging system 400 and/or include a perforated border (and/or may exclude adhesives and/or other closure material(s)/structure(s)). Additionally, or alternatively, one or both bottom panels 408 may be sized and/or shaped to receive the reference apparatus. For example, the bottom panel(s) may include a channel sized to receive at least a portion of the reference apparatus.

Reference apparatus 412 may be at least partially formed and/or incorporated within the packaging system. For example, the reference apparatus may be partially incorporated within one or both bottom panels such that the reference apparatus extends beyond at least one border of the bottom panel forming one or more free outer edges. In other examples, the reference apparatus may be incorporated within one or more bottom panels such that the reference apparatus and the bottom panel share one or more borders.

In some embodiments, the reference apparatus may be secured within the packaging system. For example, the reference apparatus may be held within a slot or pocket of the packaging system. Moreover, the reference apparatus may be any suitable dimensions and/or shape(s) and may include any number of panels. Although packaging system 400 is shown to include one reference apparatus on one bottom panel 408, the packaging system may additionally, or alternatively, include one or more reference apparatuses on any portion(s) of the packaging system. For example, a reference apparatus may be on, secured to, or incorporated with the first and/or second panels of the packaging system.

Packaging system 400 may include print information that may be useful for patients of a hospital or medical center, including providing information on how to view health records, directly contact physicians, request prescriptions, manage appointments, access billing information, seek medical care, etc. Any combinations of the above options may be included and/or omitted Additionally, FIG. 15 shows that an embodiment of packaging system 400 may include one or more sets of opposing slots 414, which may be any suitable size to secure any suitable number of items. Opposing slots 414 may be rectilinear and/or curvilinear, and configured in any shape suitable to secure any suitable type(s) of items, such as business cards, CDs, DVDs, digital cards, etc. Moreover, opposing slots 414 may include apertures (not shown) and/or other structures configured to prevent tearing or ripping of the slots. Although the opposing slots are shown on one of bottom panels 408, the opposing slots may be on both bottom panels and/or on the first and/or second panels. Additionally, although one set of opposing slots 414 are shown in FIG. 15, the packaging system may include any suitable number of sets of those slots, such as two, three, four, or more sets.

Moreover, reference apparatus 412 may have any suitable dimensions, such as 9½×2 inches. Although FIGS. 14-15 show particular dimensions for reference apparatus 412, the reference apparatus may have any suitable dimensions (such as the other dimensions described in this disclosure) that allow the reference apparatus to be attached to, or formed with, one or more panels of the packaging system.

The disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. A folder, comprising:

a unitary planar material folded along a transverse fold forming a front panel and a rear panel, the front panel being folded over the rear panel along the transverse fold, and at least one reference apparatus being formed with at least one of the front and rear panels, the at least one of the front and rear panels includes one or more perforated score lines along at least a portion of the at least one reference apparatus to allow detachment of the at least one reference apparatus from the at least one of the front and rear panels, the at least one reference apparatus includes first and second opposed ends, the at least one reference apparatus additionally includes first and second spaced folds that are disposed between the first and second opposed ends, the first and second folds are parallel to each other, the at least one reference apparatus further includes:

a first panel defined between the first end and the first fold, a second panel defined between the second end and the second fold, and a third panel disposed between the first and second panels and defined between the first and second folds, wherein, the first, second, and third panels are coplanar with the at least one of the front and rear panels, the second panel includes a slot that is adjacent to the second fold and spaced from the second end, the slot defines a tab shaped to secure an end portion of planar material between the tab and the remainder of the second panel.

2. The folder of claim 1, wherein the front panel includes a plurality of slots configured to receive at least one business card.

3. The folder of claim 2, wherein the plurality of slots includes at least one set of opposing slots.

4. The folder of claim 3, wherein each slot of the at least one set of opposing slots is curvilinear.

5. The folder of claim 1, wherein the first, second, and third panels define an elongate axis, and wherein the at least one reference apparatus is formed with the at least one of the front and rear panels such that the elongate axis is parallel to the transverse fold.

6. The folder of claim 5, wherein at least one perforated score line of the one or more perforated score lines is parallel to the transverse fold.

7. The folder of claim 5, wherein the one or more perforated score lines include first, second, and third perforated score lines, wherein the first perforated score line is longer than each of the second and third perforated score lines and is parallel to the transverse fold, and wherein the second and third perforated score lines are perpendicular to the transverse fold.

8. The folder of claim 7, wherein the second perforated score line defines the first end of the at least one reference apparatus and the third perforated score line defines the second end of the at least one reference apparatus.

9. The folder of claim 5, wherein the at least one reference apparatus is formed with the at least one of the front and rear panels such that the at least one reference apparatus is disposed between first and second portions of the at least one of the front and rear panels along the elongate axis.

10. A folder, comprising:

a unitary planar material folded along first and second transverse folds forming a front panel, a lid, and a rear panel disposed between the front panel and the lid, the front panel being folded over the rear panel along the first transverse fold, the lid being configured to be folded over the front panel along the second transverse fold to form a closure for the document receptacle, and at least one reference apparatus formed with at least one of the front panel, the rear panel, and the lid, the at least one of the front panel, the rear panel, and the lid includes one or more perforated score lines along at least a portion of the at least one reference apparatus to allow detachment of the at least one reference apparatus from the at least one of the front panel, the rear panel, and the lid, the at least one reference apparatus includes first and second opposed ends, the at least one reference apparatus additionally includes first and second spaced folds that are disposed between the first and second opposed ends, the first and second folds are parallel to each other, the at least one reference apparatus further includes:

a first panel defined between the first end and the first fold, a second panel defined between the second end and the second fold, and a third panel disposed between the first and second panels and defined between the first and second folds, wherein, the first, second, and third panels are coplanar with the at least one of the front panel, the rear panel, and the lid, the second panel includes a slot that is adjacent to the second fold and spaced from the second end, the slot defines a tab shaped to secure an end portion of planar material between the tab and the remainder of the second panel.

11. The folder of claim 10, wherein the first, second, and third panels define an elongate axis, wherein the at least one reference apparatus is formed with the at least one of the front panel, the rear panel, and the lid such that the elongate axis is parallel to the first and second transverse folds, wherein the at least one reference apparatus is formed with the at least one of the front panel, the rear panel, and the lid such that the at least one reference apparatus is disposed between first and second portions of the at least one of the front panel, the rear panel, and the lid along the elongate axis, wherein the one or more perforated score lines include first, second, and third perforated score lines, wherein the first perforated score line is longer than each of the second and third perforated score lines and is parallel to the transverse fold, wherein the second and third perforated score lines are perpendicular to the transverse fold, and wherein the second perforated score line defines the first end of the at least one reference apparatus and the third perforated score line defines the second end of the at least one reference apparatus.

12. A folder, comprising:

a unitary planar material folded along first and second folds forming one or more front panels and a rear panel, the one or more front panels being folded over the rear panel along the first fold, the rear panel having a first portion and a second portion, the first portion being configured to be folded over the second portion along the second fold, and at least one reference apparatus formed with at least one of the one or more front panels and the rear panel, the at least one of the one or more front panels and the rear panel includes one or more perforated score lines along at least a portion of the at least one reference apparatus to allow detachment of the at least one reference apparatus from the at least one of the one or more front panels and the rear panel, the at least one reference apparatus includes first and second opposed ends, the at least one reference apparatus additionally includes first and second spaced folds that are disposed between the first and second opposed ends, the first and second folds are parallel to each other, the at least one reference apparatus further includes:

a first panel defined between the first end and the first fold, a second panel defined between the second end and the second fold, and a third panel disposed between the first and second panels and defined between the first and second folds, wherein, the first, second, and third panels are coplanar with the at least one of the one or more front panels and the rear panel, the second panel includes a slot that is adjacent to the second fold and spaced from the second end, the slot defines a tab that is shaped to secure an end portion of planar material between the tab and the remainder of the second panel.

13. The folder of claim 12, wherein the one or more front panels includes a first front panel and a second front panel, the unitary planar material including a void between the first front and second front panels.

* * * * *